US006501972B1

(12) United States Patent
Carlsson et al.

(10) Patent No.: US 6,501,972 B1
(45) Date of Patent: Dec. 31, 2002

(54) PARALLEL PLATE MICROWAVE DEVICES HAVING TAPERED CURRENT INTERRUPTING SLOTS

(75) Inventors: Erik Carlsson, Mölndal (SE); Spartak Gevorgian, Göteborg (SE); Erland Wikborg, Danderyd (SE)

(73) Assignee: Telefonaktiebolaget L M Ericsson (publ) (SE)

( * ) Notice: Subject to any disclaimer, the term of this patent is extended or adjusted under 35 U.S.C. 154(b) by 0 days.

(21) Appl. No.: 09/539,797

(22) Filed: Mar. 31, 2000

(30) Foreign Application Priority Data

Apr. 1, 1999 (SE) ..... 9901190

(51) Int. Cl.[7] ..... H01P 7/00; H01B 12/02

(52) U.S. Cl. ..... 505/210; 505/700; 505/866; 333/99.005; 333/219

(58) Field of Search ..... 333/995, 205, 333/219, 235, 251; 505/210, 700, 701, 866

(56) References Cited

U.S. PATENT DOCUMENTS 3,775,694 A * 11/1973 Quine ..... 333/251 X
4,238,747 A * 12/1980 Harp et al. ..... 333/251 X
4,812,782 A * 3/1989 Ajioka ..... 333/125 X
5,172,084 A 12/1992 Fiedziuszko et al. ..... 333/204
5,710,105 A 1/1998 Shen ..... 505/210
6,187,717 B1 * 2/2001 Wikborg et al. ..... 333/995 X

FOREIGN PATENT DOCUMENTS

WO 96/42118 12/1996

OTHER PUBLICATIONS

Gevorgian, Spartak, et al., "Lower Order Modes of YBCO/STO/YBCO Circular Disk Resonators", IEEE Transaction on Microwave Theory and Techniques, vol. 44, No. 10, Oct. 1996, pp. 1738–1741.

* cited by examiner

*Primary Examiner*—Benny Lee
(74) *Attorney, Agent, or Firm*—Burns Doane et al.

(57) ABSTRACT

A microwave device includes a number of parallel-plate resonators that include at least one dielectric substrate and first and second plates arranged on either side of the substrate. At least one of the plates of each of a number of the parallel-plate resonators includes a current interrupting device such that the current lines of at least one undesired mode are interrupted at their maxima to suppress the undesired mode. There is also described a method of interrupting undesired modes in a microwave device having a number of parallel-plate resonators.

20 Claims, 6 Drawing Sheets

$TM_{010}$ $TM_{110}$ $TM_{210}$ $TM_{020}$ $TM_{310}$ $TM_{410}$ $TM_{110}$ $TM_{210}$ $TM_{020}$ $TM_{310}$ $TM_{410}$ $TM_{020}$ $TM_{020}$ $TM_{210}$

PARALLEL PLATE MICROWAVE DEVICES HAVING TAPERED CURRENT INTERRUPTING SLOTS

BACKGROUND

The present invention relates to microwave devices comprising a number of parallel-plate resonators allowing selection of modes. The invention also relates to a method of suppressing undesired modes in a microwave device.

It is often desirable to be able to select the modes of microwave devices such as microwave resonators and filters. WO 98/32187 shows the use of aperiodic gratings for mode conversion/selection. However, the grating structures/surfaces are of complex shape and long. These devices furthermore suffer the drawback of being complicated and costly to fabricate and it is also difficult to obtain a mode selectivity which is as accurate as would be desired. Still further they can not be used for thin film resonators for which the thickness is less then $\lambda_g/2$, $\lambda_g$ being the wavelengths of the microwave signal in the resonator. In several implementations it is however desirable to be able to use such resonators. Still further, the size of the resonators is changed when structures as in WO 98/32187 are used.

The Swedish patent application SE 9502137-4, which is the counterpart of allowed U.S. application Ser. No. 08/989,166, filed Dec. 11, 1997, discloses parallel-plate resonators, specially with superconducting plates for low-loss narrow-band filter applications. In "Lower Order Modes of YBCO/STO/YBCO Circular Disc Resonators", IEEE Transactions on Microwave Theory and Technics, Vol. 44 (10), pp. 1738–1741, 1996, it is shown that in electrical thin resonators (the thickness being smaller than $\lambda_g/2$), the higher order TM modes, so called whispering gallery modes, have higher quality factors. It would thus be desirable to utilize these modes in low loss narrow band filter applications. It is however a drawback related to using higher order modes since due to the resonant frequencies of these modes being very close to each other, the rejection bands of for example filters have parasitic undesirable transmission poles, i.e. in other words they are not free of spurious components. SE 9701450-0 "Arrangement and method relating to microwave devices" suggests one way to overcome this problem through the use of special mode selective coupling loops. However, such a device is comparatively bulky and most suitable for input/output coupling of resonators in multi-resonator filters. Furthermore, since the coupling loops are quite bulky for certain applications, the parasitic modes will not be sufficiently suppressed. Still further such coupling loops are not possible to use in the resonators away from the input/output ports of for example filters.

U.S. Pat. No. 5,710,105 shows high power, high temperature superconductor filters having $TM_{0i0}$ mode circular shaped high temperature superconductor planar resonators. To suppress interfering non $TM_{0i0}$ modes, radially directed slots are provided which are positioned parallel to the current of the desired operating mode and perpendicular to the current of an undesired mode. However, these slots are centered at the radius of the disk. They do not cut the maxima. Moreover such slots will affect the useful modes. Thus this device will not work as efficiently as needed. Moreover, this document merely contemplates the $TM_{0i0}$-modes as attractive for selection.

SUMMARY

Therefore microwave devices, particularly microwave resonators and filters, are needed which are mode selective, particularly with a precise mode selectivity. Particularly, devices are needed wherein means enabling mode selectivity are provided which are suitable for use for input/output coupling as well as away from input/output ports of resonators of filters. Particularly a device is needed which is small and for example comprises thin resonators, particularly having a thickness smaller than $\lambda_g/2$, $\lambda_g$ being the microwave wavelength in the resonator. Still further a device is needed through which it is possible to use higher order TM modes in low loss narrow band filter applications. Particularly a device is needed through which higher order modes having close resonant frequencies can be used and through which parasitic and undesirable transmission poles can be avoided. Particularly a device is needed through which any standard thin film fabrication technology can be used and through which mode selectivity is enabled without changing the size of the resonators. Still further a device is needed which generally is inexpensive and easy to fabricate and through which the use of higher order TM modes is enabled without problems being caused by the close resonant frequencies of such modes. A method of suppressing undesired modes in such devices is also needed. A device and a method respectively is also needed which is more efficient in suppressing undesired modes than hitherto known devices at the same time as the effect of the suppression of undesired modes on the desired modes is minimized. Further yet a device and a method respectively is needed through which any mode can be selected or suppressed.

Therefore a microwave device is provided which particularly comprises a number of parallel-plate resonators. Each parallel-plate resonator comprises at least one dielectric substrate with first and second conducting (superconducting) plates arranged on either side of said dielectric substrate. The field (the field produced by coupling arrangement or similar, e.g. discussed in the applications by the same applicant which are incorporated herein by reference above) generates currents in both of the plates of the parallel-plate resonator or resonators (the resonator is thin). At least one of the first and second plates of each of a number of the parallel-plate resonators is patterned or formed in such a way, or comprises current interrupting means, that the current lines of at least one undesired mode are interrupted at their maxima (where the current lines have a maximum) to suppress the undesired mode or modes, thus providing for selectivity. The current interrupting means may be provided in a number of different ways, as actual means or as a particular pattern in, or forming of, the resonators. According to one embodiment the current interrupting means are constituted of cuts in at least one resonator plate of one or more parallel-plate resonators. Particularly the resonator plates comprise metal and the current interrupting means consists of metal being removed except for along the current lines of the desired modes which, in other words, means that the parallel-plate resonator is patterned or formed in such a way.

In an alternative embodiment, the resonator plates comprising metal strips, are the current interrupting means formed by resistive strips arranged along the current lines of the undesired modes, thus replacing the metal strips. This is particularly convenient if the device comprises a number of electrically tunable resonators requiring whole resonator plates, i.e. resonator plates which should not contain any cuts or similar. Also in other implementations requiring "whole" resonator plates this implementation consisting of replacing metal strips through resistive strips, is appropriate.

For parallel-plate resonators, or devices built of or including parallel-plate resonators, the current interrupting means may either be provided on one only of the resonator plates of a respective parallel-plate resonator or current interrupting means may be provided on both plates. In a particular implementation the device comprises one or more circular parallel-plate resonators.

Particularly one or more modes are suppressed. In some embodiments the current interrupting means, i.e. the cuts, resistive films or removed metal parts, are arranged to interrupt the current lines of for example one or more of the $TM_{210}$, $TM_{310}$ and $TM_{410}$ modes respectively. Then a number of current interrupting means are arranged which are directed substantially towards the center of the circular parallel-plate resonator. The current interrupting means are so formed that they have a larger width at the edge of the disc whereas the width is substantially zero, or zero, at the midpoint or at a distance from the midpoint thus promoting the desired modes, or not affecting the desired modes.

In one embodiment the current interrupting means are arranged at a distance from the periphery and along at least a part (exceeding 180°) in the form of a stripe or similar of at least one plate to suppress the $TM_{020}$ mode. In one embodiment current interrupting means are arranged to suppress the $TM_{110}$ mode and the current interrupting means are then arranged along a diameter of at least one of the resonator plates and forming substantially 90° of the current lines to suppress the mode.

In alternative embodiments a parallel-plate resonator is rectangular, square-shaped or of any appropriate regular or irregular shape.

In a number of alternative embodiments current interrupting means are provided for both plates of a parallel-plate resonator. The current interrupting means of each of the plates of a parallel-plate resonator may then be similar and symmetrical. Also in this case a parallel-plate resonator may be circular, square-shaped, rectangular or of any other convenient shape.

In a particular embodiment the device relates to a filter formed of a number of parallel-plate resonators as referred to above. In a particular implementation the filter is a narrow-band filter.

The electric substrate of the resonator may consists of different materials such as alumina ($Al_2O_3$), sapphire, quartz, STO etc. The plates may be normal metal plates, superconducting plates or particularly high temperature superconducting. The inventive concept is particularly applicable on devices as disclosed in the Swedish patent application "Tunable Microwave Devices", 9502137-4, which is the counterpart of allowed U.S. application Ser. No. 08/989,166, filed Dec. 11, 1997 and is hereby incorporated herein by reference. The device enabling exact mode selectivity can advantageously be used in wireless communication systems.

A method of suppressing undesired modes in a microwave device which comprises a number of parallel-plate resonators wherein each resonator includes a first and a second plate and wherein a field generates currents in both of said electrode plates is disclosed which comprises the step of interrupting the maximas of the current lines of the undesired modes in at least one of said plates. According to one implementation the method comprises the step of providing cuts/slots to interrupt the current lines of the undesired mode or modes in the maximas in at least one of the plates. In a particular implementation symmetric cuts/slots are provided in both electrode plates.

In an alternative embodiment a method comprises the step of removing electrode plates throughout at least one of the plates except for along the current lines of the desired mode or modes. In still another embodiment a method includes—the step of arranging resistive strips along the current lines of undesired modes as a replacement for existing metal strips of said resonator plate or plates.

According to the invention the cuts/slots/resistive strips/removed material are positioned predominantly at the maximas of the current lines or current distribution of the modes to be suppressed and at the minimas of the current lines (distribution of the desired modes).

The cuts/slots/resistive strips/removed material may in general have a rectangular shape, but preferably their shape is selected based on the current distribution of undesired modes such that they are maximally suppressed while leaving the desired modes to the highest possible extent unaffected. Thus a careful observation of the maximas of current lines of undesired modes is highly important.

Moreover, according to the inventive concept also other modes than the $TM_{020}$ or particularly $TM_{020}$, can be selected as desired modes. Such other modes may have a higher Q-factor which make them very attractive for the fabrication of the filters.

BRIEF DESCRIPTION OF THE DRAWINGS

The invention will in the following be further described in a non-limiting way and with reference to the accompanying drawings, in which.

DETAILED DESCRIPTION

Figure 1A:
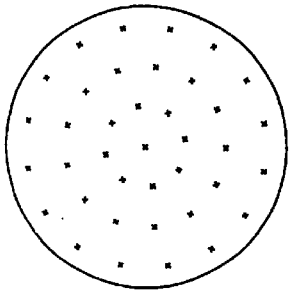
FIGS. 1A–1F current lines (field distribution) for a number of different TM-modes for a circular parallel-plate resonator.
Figure 1B:
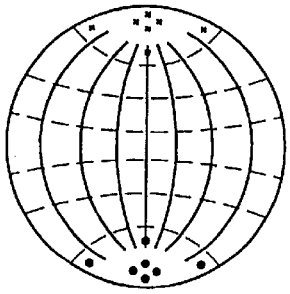
Figure 1C:
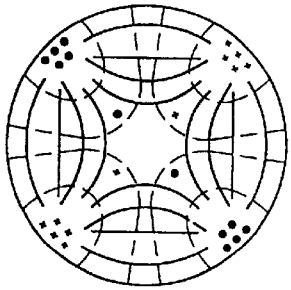
Figure 1D:
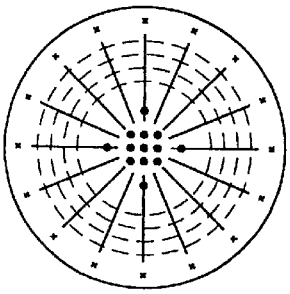
Figure 1E:
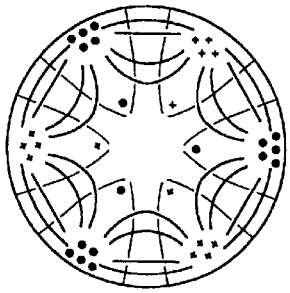
Figure 1F:
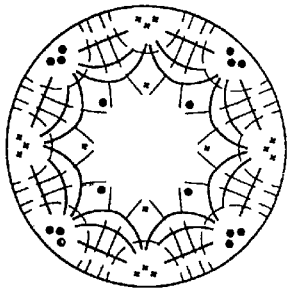

FIGS. 1A–1F disclose for illustrative purposes the lower order $TM_{nmp}$, field distributions for a circular parallel-plate resonator, i.e. the $TM_{010}$, $TM_{110}$, $TM_{210}$, $TM_{020}$, $TM_{310}$, $TM_{410}$ modes in FIGS. 1A–1F, respectively. Solid lines indicate the current, dashed lines indicate the magnetic field and dots and crosses indicate the electric field. It is assumed that p=0, i.e. in other words that the thickness of the plate is smaller than a half wavelength in the resonator and that the resonator only supports $TM_{nm0}$ modes. In all cases the field/current distributions are fixed in space by coupling arrangements (coupling loop, coupling probe, or a second resonator).

The current distributions for interfering (non $TM_{0i0}$) modes are "peaking" near the edges of a resonator disk, i.e. the peak values of the currents are near the circumference of the disk. (See also FIG. 3 to FIG. 10). Parallel-plate resonators e.g. in the form of circular dielectric disks and circular patches on dielectric substrates, may find a number of microwave applications. The resonators are regarded electrically thin if their thickness d is smaller then the wavelength of the microwave signals in the resonator, $d<\lambda_g/2$, so that no standing waves are present along the axis of the disk. Applications in filters and antennas for characterization of thin film High Temperature Superconductors (HTS) have been discussed in the past. Recently electrically tunable resonators based on circular ferroelectric disks have attracted much attention for applications in the tunable filters for modem microwave communication systems. A simplified electrodynamic analysis of a parallel-plate resonator proposes a simple formula for the resonant frequency:

$$f_{nm0} = \frac{c_0 k_{nm}}{2\pi r\sqrt{\varepsilon}}$$

where $c_0=3.10^8$ m/s is the velocity of light in vacuum, $\epsilon$ is the relative dielectric constant of disk/substrate, r is the radius of the conducting plate, and $k_{nm}$, are the roots of Bessel functions with mode indexes n and m. For an electrically thin parallel-plate resonator the third index, l=0. The above formula may be corrected taking fringing fields into account.

Attractive for filter applications are e.g. the axially symmetric modes with the plate currents only in radial direction. These modes are characterized by higher quality (Q) factors since they do not have surface currents along the edges of conductor plates. Extremely high Q-factors in circular patch resonators with HTS plates have been achieved due to the exploitation of the first axially symmetric mode. This mode is widely regarded as $TM_{010}$ as a mode accommodating one antinode in the radial direction. According to this approach the mode $TM_{110}$ should also have one antinode along the radius, which is not true. In all published presentations this $TM_{110}$ has one antinode along the diameter. It has been mentioned that the first axially symmetric mode should be denoted as $TM_{020}$, instead of $TM_{010}$. This incorrect interpretation of mode indexes leads to confusion not only for $TM_{010}$, but also for the other modes, and moreover, to incorrect interpretation of experimentally observed higher order modes, especially for multi-mode resonators. On the other hand correct identification of experimentally observed modes is a critical issue in the evaluation of the field/current distributions in the resonators. Knowledge of these distributions is required particularly in the designing of coupling elements (probe, loop), coupling between resonators in multiresonator filters, in case of designing of mode selective components in multi-mode resonators etc. These and similar problems may be easily solved by using a mode chart of parallel-plate resonators as discussed below.

For the purposes of mode chart discussions the fringing electric fields at the edges of the disk(s) may be ignored. This is equivalent to assuming a magnetic wall at the ρ=r boundary, in a cylindrical co-ordinate system. Analytic solutions for the fields inside the resonator are then available as:

$$E_z=E_o J_n(\beta\rho)\cos(m\psi+\xi) \tag{1}$$

$$H_p = \frac{j\omega\varepsilon\varepsilon_o n}{\beta^2\rho} E_o J_n(\beta\rho)\sin(n\varphi+\xi) \tag{2}$$

$$H_\varphi = \frac{j\omega\varepsilon\varepsilon_o}{\beta} E_o J'_n(\beta\rho)\cos(n\varphi+\xi) \tag{3}$$

$J_n(\beta\rho)$ and $J'_n(\beta\rho)$ are the Bessel functions of the n-th order and their derivatives, β is the wavenumber, and ζ=0 or π/2, corresponding to two degenerate modes in a fully symmetric resonator. From (3) the magnetic wall approximation at ρ=r leads to $$J'_n(k_{nm}(\beta_{nm}r)=0$$

Table I below summarizes the roots, $k_{nm}$, of twenty modes given in 5 increasing order, to reflect increasing order of resonant frequencies. Indices m=1,2,3 . . . shows the number of zeros of the $J'_n(\beta\rho)$ function over the radius of the disk. The table indicates mode indexes and numbers of field maximas and it is useful in computations, where absolute values of wavenumber are required for resonant frequency computation, evaluation of field/current distributions or evaluation of equivalent circuit parameters and Q-factors of the modes.

TABLE I

| | | Roots of | Mode Indices | | Number of Field Maxima | |
|---|---|---|---|---|---|---|
| | Mode $TM_{nm0}$ | $J'_n(K_{nm}) = 0$ $K_{nm}$ | Angular n | Radial m | Angular p | Diametrical q |
| 1 | $TM_{010}$ | 0 | 0 | 1 | 0 | 0 |
| 2 | $TM_{110}$ | 1.8412 | 1 | 1 | 1 | 1 |
| 3 | $TM_{210}$ | 3.0542 | 2 | 1 | 2 | 2 |
| 4 | $TM_{020}$ | 3.8317 | 0 | 2 | 0 | 2 |
| 5 | $TM_{310}$ | 4.2012 | 3 | 1 | 3 | 2 |
| 6 | $TM_{410}$ | 5.3176 | 4 | 1 | 4 | 2 |
| 7 | $TM_{120}$ | 5.3314 | 1 | 2 | 1 | 3 |
| 8 | $TM_{510}$ | 6.4156 | 5 | 1 | 5 | 2 |
| 9 | $TM_{220}$ | 6.7061 | 2 | 2 | 2 | 4 |
| 10 | $TM_{030}$ | 7.0156 | 0 | 3 | 0 | 4 |
| 11 | $TM_{610}$ | 7.5013 | 6 | 1 | 6 | 2 |
| 12 | $TM_{320}$ | 8.0152 | 3 | 2 | 3 | 4 |
| 13 | $TM_{130}$ | 8.5363 | 1 | 3 | 1 | 5 |
| 14 | $TM_{710}$ | 8.5778 | 7 | 1 | 7 | 2 |
| 15 | $TM_{420}$ | 9.2824 | 4 | 2 | 4 | 4 |
| 16 | $TM_{810}$ | 9.6474 | 8 | 1 | 8 | 2 |
| 17 | $TM_{230}$ | 9.9695 | 2 | 3 | 2 | 6 |
| 18 | $TM_{040}$ | 10.1735 | 0 | 4 | 0 | 6 |
| 19 | $TM_{520}$ | 10.5199 | 5 | 2 | 5 | 4 |
| 20 | $TM_{910}$ | 10.7114 | 9 | 1 | 9 | 2 |

Some of the mode field distributions, in any plane parallel to the plate, in the form of vector plots are shown in a simplified manner in FIGS. 1A–1F. The vector plots of surface currents have similar patterns where the vectors in FIG. 1A–1F are rotated 90°, owing to the simple relationship between surface currents and tangential magnetic fields, $\bar{J}_s=\bar{z}x\bar{H}_t$, where $\bar{z}$ is a unit vector normal to the surface of the plate. Indexes n and m shown in Table I have straightforward mathematical explanations in terms of solutions of equation $J'_n(k\Sigma)=0$, i.e. they indicate the angular and radial numbers of zeros of Bessel functions and magnetic field. In other words these are angular and radial mode indices.

Figure 2:
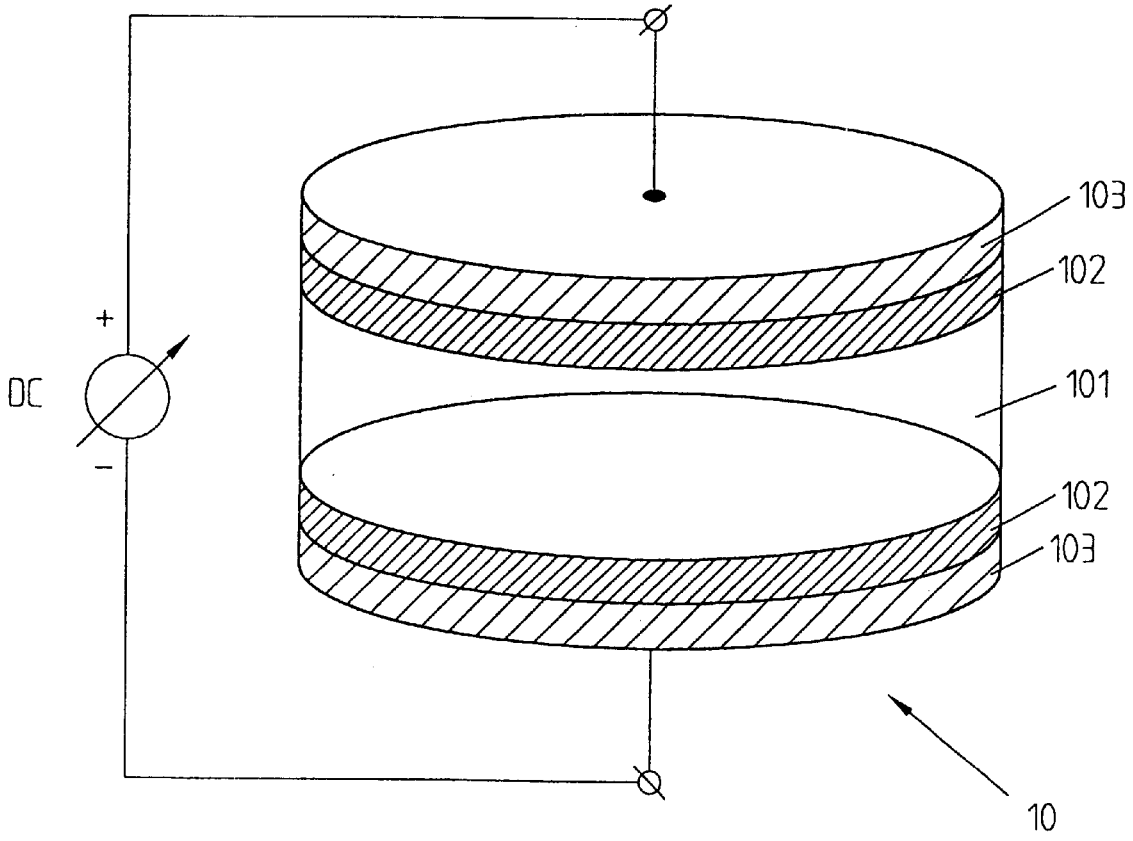
FIG. 2 shows an example of a circular parallel-plate resonator.

FIG. 2 shows an example of a circular parallel-plate resonator 10 in which a non-linear bulk dielectric substrate 101, which has a high dielectric constant, is covered by two superconducting films 102 on either side thereof. The low loss non-linear dielectric substrate 101 and the two superconducting films 102 (below their critical temperature) comprise a microwave parallel-plate resonator 10 with a high quality factor, also called a Q-factor. Via a variable DC-voltage source DC a tunable voltage may be applied. Although an electrically tunable resonator is shown, the invention is of course not limited to electrically tunable devices—this merely constitutes an example. The resonators may also be tunable by other means or not tunable.

The superconducting films 102 may be high temperature superconducting films although they do not have to be such films, they may also be normally superconducting or normally conducting. In the illustrated embodiment the superconducting films are covered by non-superconducting high conductivity films 103 of for example gold, silver, copper or similar. Such devices are further discussed in "Tunable Microwave Devices" which is a Swedish patent application filed by the same applicant as referred to earlier. Also other parallel-plate resonators can however be used for example with only metal plates on either side of a substrate. The invention is not limited to any particular kind of parallel-plate resonators and any low loss dielectric can be used, such as for example alumina ($Al_2O_3$), sapphire, quartz, STO ($SrTiO_3$). Parallel-plate resonators as disclosed in the above mentioned Swedish patent application, which was incorporated herein by reference, are proposed e.g. for low loss narrow band filter applications. In the above mentioned patent application it is also shown that in electrically thin parallel-plate resonators (which have a thickness smaller than $\lambda_g/2$, wherein $\lambda_g$ is the wavelength in the resonator) the higher order TM modes have higher quality factors. In a thin parallel-plate resonator the field generates currents in both plates.

Figure 3:
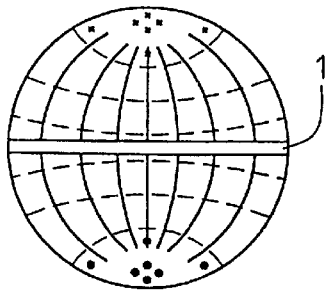
FIG. 3 shows an example on current interrupting means suppressing the $TM_{110}$ mode.

FIG. 3 shows an example with current interrupting means interrupting the maxima of the current lines of the $TM_{110}$ mode. The current interrupting means 1 in this embodiment consists of a cut or slot 1. The cut 1 is arranged diametrically across the resonator plate orthogonally to the current lines.

Figure 4:
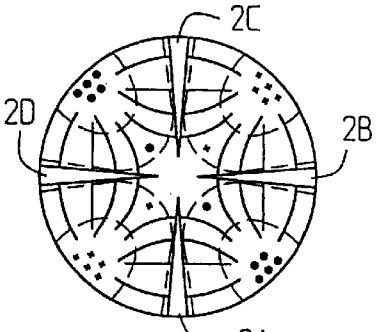
FIG. 4 illustrates an embodiment in which the $TM_{210}$ mode is suppressed.
Figure 9:
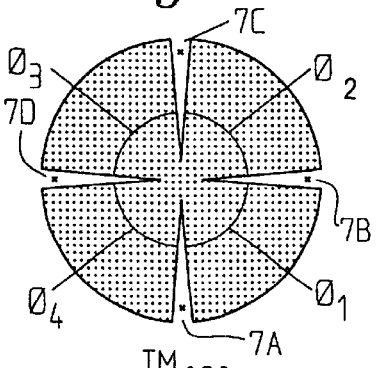
FIG. 9 shows an alternative embodiment for suppressing the $TM_{110}$ and $TM_{210}$ modes respectively.

In FIG. 4 current interrupting means 2A, 2B, 2C, 2D are used to interrupt the current lines of the $TM_{210}$ mode and also in this embodiment the current interrupting means consist of cuts/slots directed towards the center (substantially) of the plate. The cuts are wider at the periphery and ends before the midpoint so as to cut the current lines of the undesired mode at the maximum and as little as possible affect main useful modes, for which the current has a maximum approximately at the midpoint. This is also illustrated in FIGS. 6, 7 and 9.

Figure 5:
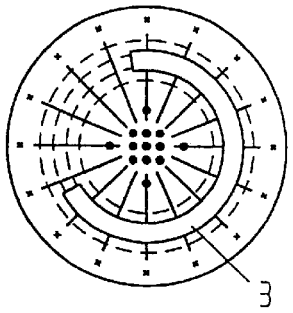
FIG. 5 is an embodiment illustrating current interrupting means for suppressing the $TM_{020}$ mode.

In FIG. 5 the current interrupting means 3 are arranged to interrupt the current lines of the $TM_{020}$ mode and comprises a cut/slot in parallel to the periphery of the circular parallel-plate resonator and extending throughout at least 180°. The 5 current interrupting means are also here provided at the maximum of the current distribution of the undesired mode which here is $TM_{020}$.

Figure 6:
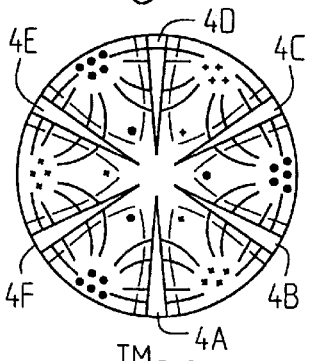
FIG. 6 shows an embodiment of current interrupting means suppressing the $TM_{310}$ mode.
Figure 7:
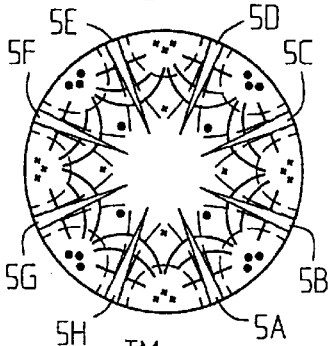
FIG. 7 shows current interrupting means suppressing the $TM_{410}$ mode.

In FIG. 6 current interrupting means 4A, 4B, 4C, 4D, 4E, 4F comprise cuts/slots interrupting the $TM_{310}$ mode whereas in FIG. 7 current interrupting means (also here cuts/slots) 5A, 5B, 5C, 5D, 5E, 5F, 5G, 5H interrupt the $TM_{410}$ mode.

The current interrupting means of FIGS. 3–7 can be arranged either in/on one of the plates of the parallel-plate resonator or in both. The angle between the current interrupting means is the same as the angles between the current distribution pattern. In case they are arranged on one plate only, the angles between their respective current interrupting means 2A, 2B, 2C, 2D are identical. The current interrupting means 4A, 4B . . . 4F are also identical and equal to 60°. Finally the current interrupting means 5A, . . . 5H are arranged at angles being identical to 45°. The behavior is similar for higher order modes (not shown herein). According to other embodiments, not shown explicitly herein, the current interrupting means as disclosed above may be provided for both plates of a parallel-plate resonator. Then the angles may be 90°, 60° or 45° respectively. Of course also other angles are possible.

FIGS. 3–7 all relate to current interrupting means in the form of cuts or slots. However, in alternative embodiments the current interrupting means comprise resistive films replacing metal strips along the current lines of undesired modes or of removed metal parts in one or both electrode plates. Of course also the resistive films may be arranged on either one or both of the plates. The current interrupting means may still be arranged as discussed above. The current patterns are fixed in space and the current interrupting means are fixed in relation to the current patterns; otherwise it will not function.

Figure 8:
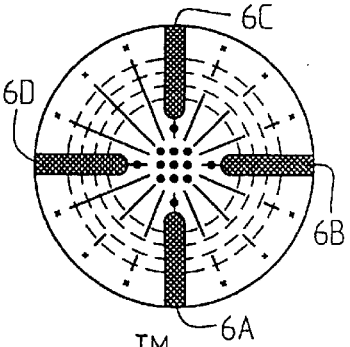
FIG. 8 shows one embodiment for suppressing the $TM_{110}$ and $TM_{210}$ modes.

In FIG. 8 an embodiment is illustrated for the $TM_{020}$ mode $TM_{020}$ in which the current interrupting means 6A, 6B, 6C, 6D comprise a resistive film suppressing $TM_{110}$ and $TM_{210}$ modes. The angles between the films or removed parts or resistive films are equal to 90° as also discussed above. Current interrupting means in the form of a resistive film may with advantage be used when whole electrode plates are desired, which for example is the case for electrically tunable resonators.

Also when the current interrupting means are provided in form of resistive films or removed parts, advantageously the shape is such that it is wider at the periphery and narrower at the midpoint or ends before the midpoint, cf. discussion above with reference to FIG. 4.

FIG. 9 shows an embodiment for the $TM_{020}$ mode $TM_{020}$ in which the current interrupting means 7A, 7B, 7C, 7D comprise removed parts in an electrode (or both electrodes as discussed above). Also in this case only the $TM_{020}$ mode is supported if the angles $\theta_1$, $\theta_2$, $\theta_3$, $\theta_4$ between the removed parts are equal to 90°.

In all the embodiments disclosed above, the number of cuts or slots or resistive strips and the corresponding widths thereof are made as small as possible in order not to affect the Q-factor of the desired mode, i.e. the effect on desired modes is minimized.

Figure 10:
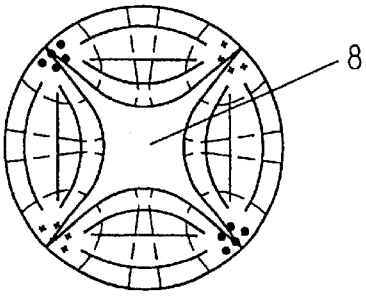
FIG. 10 shows an embodiment for supporting only the $TM_{210}$ mode, FIG. 11A schematically illustrates a cross-section of a three pole filter.

FIG. 10 shows an embodiment in which the current interrupting means 8 comprises removable metal film and in this embodiment only the $TM_{210}$ mode $TM_{210}$ is kept.

Figure 11A:
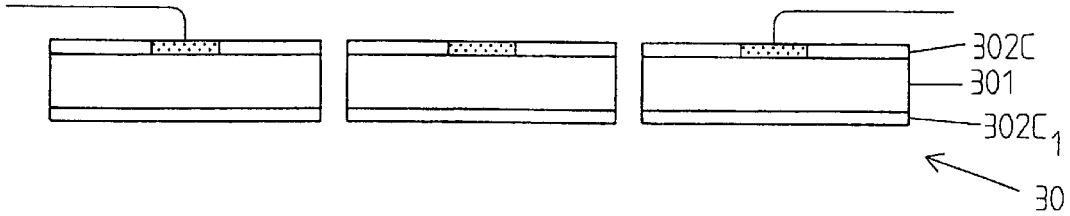
FIG. 11B illustrates current interrupting means for the filter of FIG. 11A in which the $TM_{020}$ mode is selected, FIG. 12A schematically illustrates a rectangular parallel-plate resonator.

FIG. 11A very schematically illustrates a cross-sectional view of a three pole filter 30 based on the selected $TM_{020}$ mode.

Figure 11B:
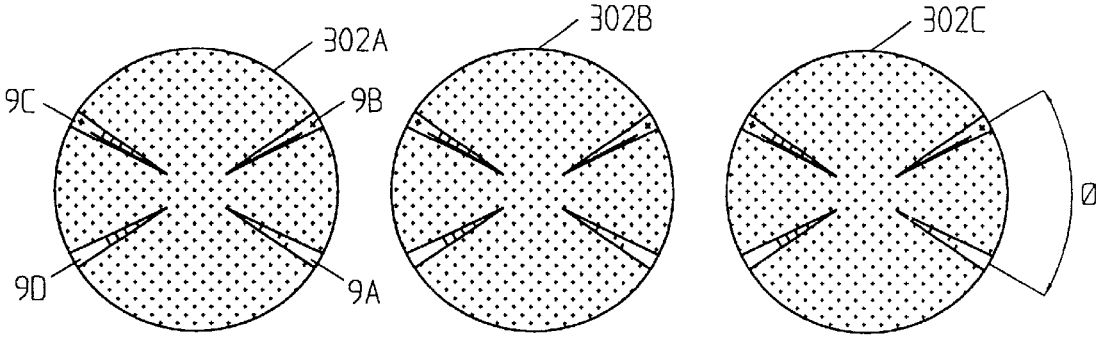

FIG. 11B shows the top-electrode plates 302A, 302B, 302C of the three pole filter of FIG. 11A. The three pole filter is electrically tunable and parts 9A, 9B, 9C, 9D are removed from the electrodes. The angles θ between the respective removed parts corresponding to the current interrupting means are equal to 90°. In the three pole filter 30 of FIG. 11A, reference numeral 301 corresponds to the substrate, reference numeral 302C correspond to the respective upper electrodes whereas reference numeral 302$C_1$ corresponds to the bottom electrode plates. In this particular embodiment the current interrupting means are only provided on the top electrodes. Of course, in an alternative embodiment a similar pattern may be formed on the bottom plates 302$C_1$.

Figure 12A:
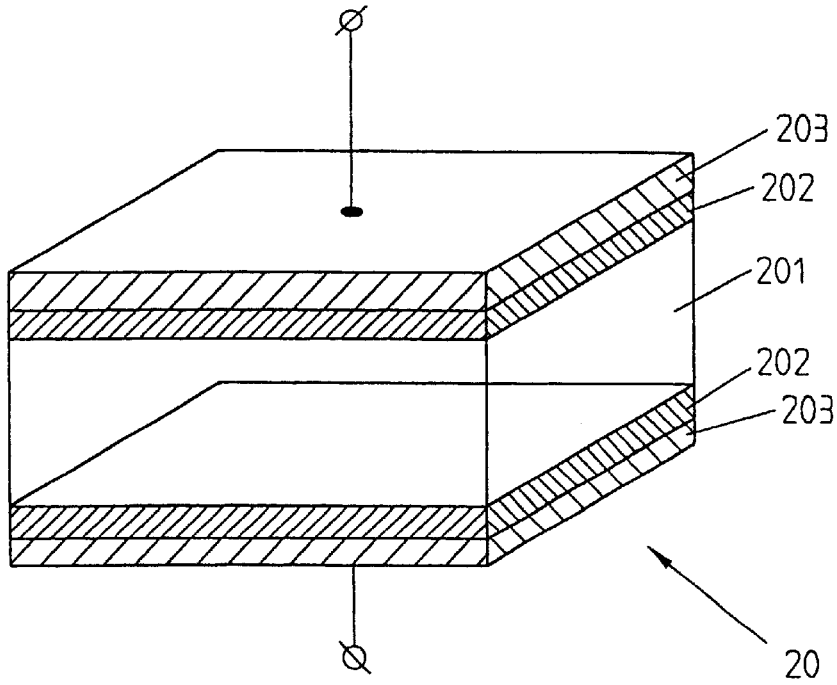
FIG. 12B shows an implementation of the rectangular parallel-plate resonator of FIG. 12A for suppressing the fundamental mode.
FIG. 12C shows an implementation of a rectangular parallel-plate resonator of FIG. 12A for suppressing the mode having m=2.

FIG. 12A schematically illustrates a square-shaped parallel-plate resonator 20. Like in FIG. 2 a substrate 201 is covered on either side by electrodes 202, which may be superconductors. In the particular embodiment non-superconducting high conductivity films 203 are in turn provided on the superconductors. These are not necessary for the functioning. Instead of films 202, 203 may simply a metal conductor be provided. As for the embodiment as disclosed in FIG. 2 they merely relate to one particular embodiment and there may also simply be one electrode plate on either side of the substrate 101. Also in this case the parallel plate resonator is electrically tunable which however of course not is necessarily the case.

Figure 12B:
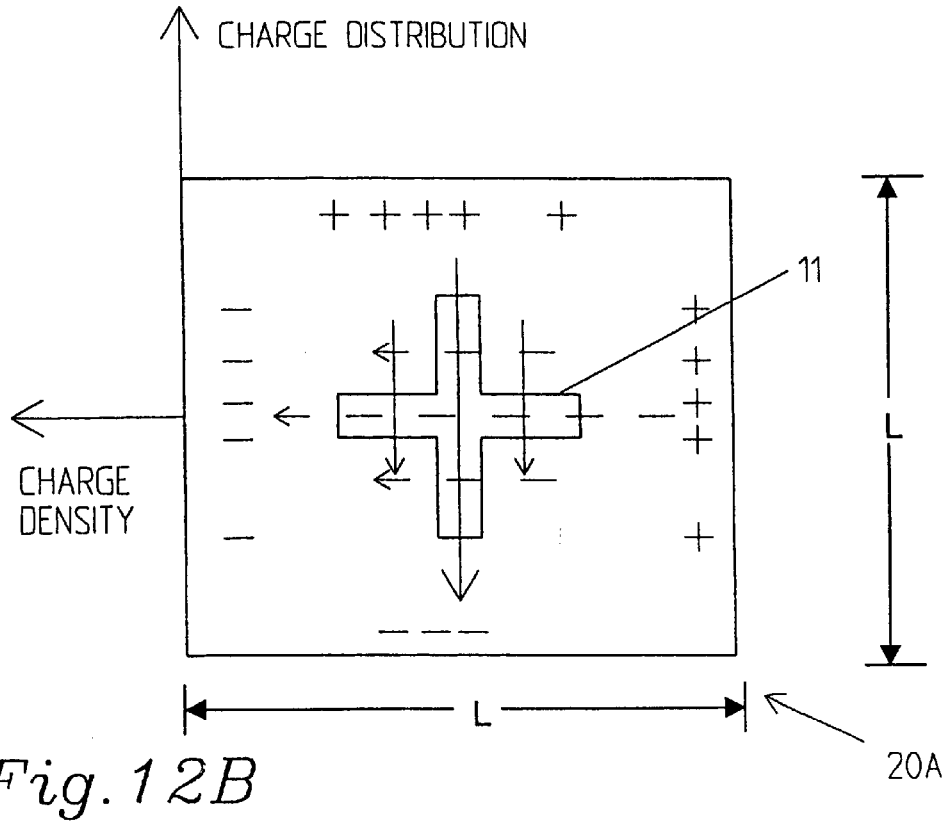

In FIG. 12B a square-shaped parallel-plate resonator 20A is illustrated having length and width equal to L. Also illustrated in the figure are charge distribution and charge density orthogonal axes. Plus (+) and minus (−) in the figure indicate the charges. In FIG. 12B current interrupting means 11 are arranged which are used to suppress the fundamental (m=1) mode.

Figure 12C:
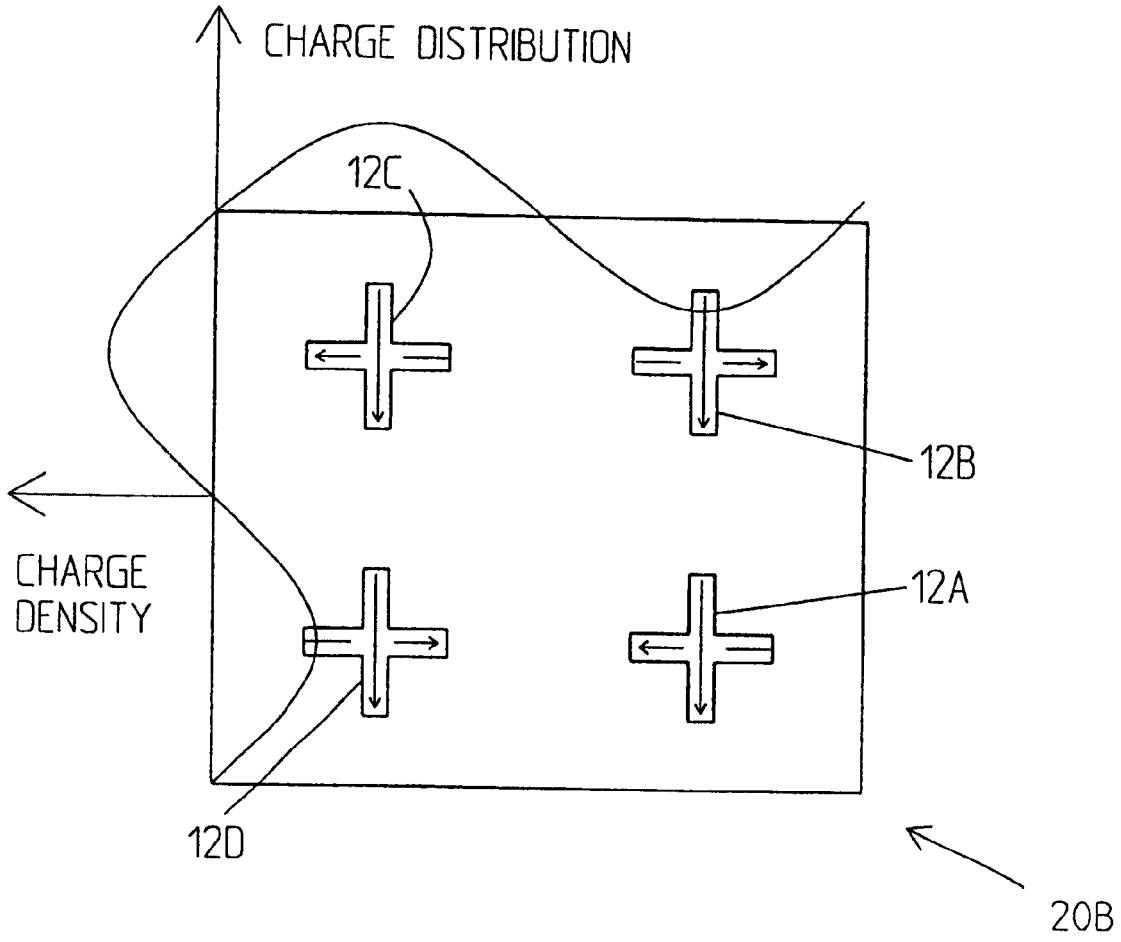

In FIG. 12C a parallel-plate square-shaped resonator 20B similar to that of FIG. 12B is illustrated, also with charge distribution and charge density orthogonal axes. In this case current interrupting means 12A, 12B, 12C, 12D are illustrated which are used to suppress the mode with m=2. It should all be clear that these only constitute examples on current interrupting means in the form of cuts or removed plate for suppressing some particular modes. A number of alternatives are of course also possible like for the circular resonators.

It should be clear that the invention can be varied in a number ways within the scope of the claims. The invention is not limited to the explicitly shown resonators or filters but it can be used for in principle any parallel-plate resonator, filter or similar. More generally it can be implemented for any microwave device requiring precise mode selectivity and which is based on parallel-plate resonators. Particularly the inventive concept is implementable on all devices illustrated in "Tunable Microwave Devices" as disclosed in the earlier mentioned Swedish patent application, SE 9502137-4.

What is claimed is:

1. A microwave device, comprising a number of parallel-plate resonators that each include a dielectric substrate and first and second superconducting plates disposed on either side of the respective substrate, wherein at least one of the plates in each of a plurality of the resonators includes means for interrupting current lines of at least one undesired mode of a magnetic field in the respective resonator, the interrupted current lines being interrupted substantially at maxima of the interrupted current lines to suppress the at least one undesired mode, wherein at least one resonator is a circular parallel-plate resonator with the current interrupting means being centrally directed, wider towards a periphery of the at least one resonator, and narrower towards a midpoint of the at least one resonator.

2. The device of claim 1, wherein two or more of the number of resonators constitute a filter.

3. The device of claim 2, wherein the filter is a narrow-band filter.

4. The device of claim 2, wherein the filter is included in a wireless communication system.

5. The device of claim 1, wherein the current interrupting means in at least one resonator comprises respective cuts or slots positioned predominantly at the maxima of the interrupted current lines and at minima of current lines of at least one desired mode of the magnetic field.

6. The device of claim 1, wherein the respective plates in at least one resonator are metal, and the current interrupting means in the at least one resonator comprises voids located in the metal except along current lines of at least one desired mode of the magnetic field.

7. The device of claim 1, wherein the respective plates in at least one resonator comprise metal strips, and the current interrupting means in the at least one resonator comprises respective resistive strips that are arranged along the interrupted current lines, the respective resistive strips having shapes determined such that the at least one undesired mode is maximally suppressed and that at least one desired mode of the magnetic field is minimally affected.

8. The device of claim 7, wherein at least one resonator is electrically tunable.

9. The device of claim 1, wherein only one of the plates in each of a plurality of the resonators includes current interrupting means.

10. The device of claim 9, wherein at least one other resonator has a shape that is one of rectangular or square.

11. The device of claim 1, wherein the at least one dielectric substrate comprises either at least one of alumina, sapphire, quartz, or SrTiO3.

12. The device of claim 1, wherein the current interrupting means in the circular parallel-plate resonator are disposed with an angle between adjacent current interrupting means of at least one of 45°, 60°, and 90° for interrupting current lines of at least one of TM210, TM310, and TM410 modes of the magnetic field, respectively.

13. The device of claim 1, wherein both of the plates in each of a plurality of the resonators include current interrupting means.

14. A microwave device, comprising a number of parallel-plate resonators that each include a dielectric substrate and first and second superconducting plates disposed on either side of the respective substrate, wherein at least one of the plates in each of a plurality of the resonators includes means for interrupting current lines of at least one undesired mode of a magnetic field in the respective resonator, the interrupted current lines being interrupted substantially at maxima of the interrupted current lines to suppress the at least one undesired mode, wherein the current interrupting means in at least one resonator are arranged along a diameter of at least one of the plates such that the current interrupting means form an angle of substantially 90° with respect to current lines to suppress a TM110 mode of the magnetic field.

15. A method of suppressing at least one undesired mode of a magnetic field in a microwave device that includes a number of parallel-plate resonators, each resonator having respective first and second plates in which currents are generated when the magnetic field is applied, the method comprising the step of interrupting current lines of the at least one undesired mode in at least one of plates of at least one of the resonators at maxima of the interrupted current lines, wherein at least one resonator is a circular parallel-plate resonator and the current lines are interrupted by providing interrupting means that are centrally directed, wider towards a periphery of the resonator, and narrower towards a midpoint of the resonator.

16. The method of claim 15, wherein the respective plates of the at least one resonator comprise corresponding metal strips and the interrupting step comprises replacing at least one metal strip with at least one resistive strip along current lines of the at least one undesired mode.

17. The method of claim 15, wherein the interrupting step comprises the step of providing respective cuts or slots as the interrupting means in at least one of the plates of at least one of the resonators to interrupt current lines of the at least one undesired mode.

18. The method of claim 17, wherein the respective cuts or slots are provided symmetrically and in both plates of at least one of the resonators.

19. The method of claim 17, wherein the respective plates of the at least one resonator are metal and the respective cuts or slots are provided by removing metal throughout at least one of the plates except along current lines of at least one desired mode of the magnetic field.

20. A microwave device, comprising a number of parallel-plate resonators that each include a dielectric substrate and first and second superconducting plates disposed on either side of the respective substrate, wherein at least one of the plates in each of a plurality of the resonators includes means for interrupting current lines of at least one undesired mode of a magnetic field in the respective resonator, the interrupted current lines being interrupted substantially at maxima of the interrupted current lines to suppress the at least one undesired mode, wherein the current interrupting means in at least one resonator are radially arranged around at least 180° of at least one plate in the respective resonator and at the same distance from a periphery of the respective resonator to suppress a TM020 mode of the magnetic field.

* * * * *